US008876078B1

(12) United States Patent
Gates

(10) Patent No.: US 8,876,078 B1
(45) Date of Patent: Nov. 4, 2014

(54) HVAC INSPECTION FRAME DEVICE

(71) Applicant: Daniel N. Gates, Clear Lake, SD (US)

(72) Inventor: Daniel N. Gates, Clear Lake, SD (US)

( * ) Notice: Subject to any disclaimer, the term of this patent is extended or adjusted under 35 U.S.C. 154(b) by 5 days.

(21) Appl. No.: 13/771,639

(22) Filed: Feb. 20, 2013

(51) Int. Cl.
*F16M 13/00* (2006.01)

(52) U.S. Cl.
CPC ..... *F16M 13/00* (2013.01)
USPC ..... 248/542; 248/672; 165/67

(58) Field of Classification Search
USPC ..... 248/542, 637, 639, 672; 62/515, 426, 62/259.1, 259.4; 165/67; 312/236
See application file for complete search history.

(56) References Cited

U.S. PATENT DOCUMENTS 4,827,901 A * 5/1989 Jackson et al. ..... 126/110 R
5,052,190 A 10/1991 Gregory
6,782,708 B1 8/2004 Boer
6,866,089 B2 3/2005 Avila
7,219,508 B2 5/2007 Durbin
7,596,958 B2 10/2009 Wagner et al.
2002/0152760 A1* 10/2002 Okuda et al. ..... 62/259.2
2010/0107496 A1* 5/2010 Faria ..... 49/149
2010/0202905 A1* 8/2010 Marioni ..... 417/423.14

* cited by examiner

*Primary Examiner* — Bradley Duckworth

(57) ABSTRACT

An HVAC inspection frame device facilitates inspection within an HVAC system. The device includes a frame having a perimeter wall defining a channel extending through the frame. A lower flange is coupled to the frame extending inwardly into the channel from an interior face of the perimeter wall. Thus, the lower flange is configured for supporting the frame on a furnace. An upper flange is coupled to the frame extending inwardly into the channel from the interior face of the perimeter wall. Thus, the upper flange is configured to support the evaporator coil on the upper flange. An aperture is positioned in the perimeter wall for insertion of an optical inspection device to provide an image of the evaporator coil or furnace without time consuming disassembly or drilling of existing structure. A plug is insertable into the aperture engaging the perimeter wall and closing the aperture.

7 Claims, 4 Drawing Sheets

HVAC INSPECTION FRAME DEVICE

FIELD OF THE DISCLOSURE

The disclosure relates to HVAC equipment frame devices and more particularly pertains to a new HVAC equipment frame device for facilitating inspection within an HVAC system.

SUMMARY OF THE DISCLOSURE

An embodiment of the disclosure meets the needs presented above by generally comprising a frame having a perimeter wall defining a channel extending from a bottom of the frame to a top of the frame. A lower flange is coupled to the frame extending inwardly into the channel from an interior face of the perimeter wall. Thus, the lower flange is configured for supporting the frame on a furnace. An upper flange is coupled to the frame extending inwardly into the channel from the interior face of the perimeter wall. Thus, the upper flange is configured to support the evaporator coil on the upper flange. An aperture is positioned in the perimeter wall for insertion of an optical inspection device to provide an image of the evaporator coil or furnace without time consuming disassembly or drilling of existing structure. A plug is insertable into the aperture engaging the perimeter wall and closing the aperture.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
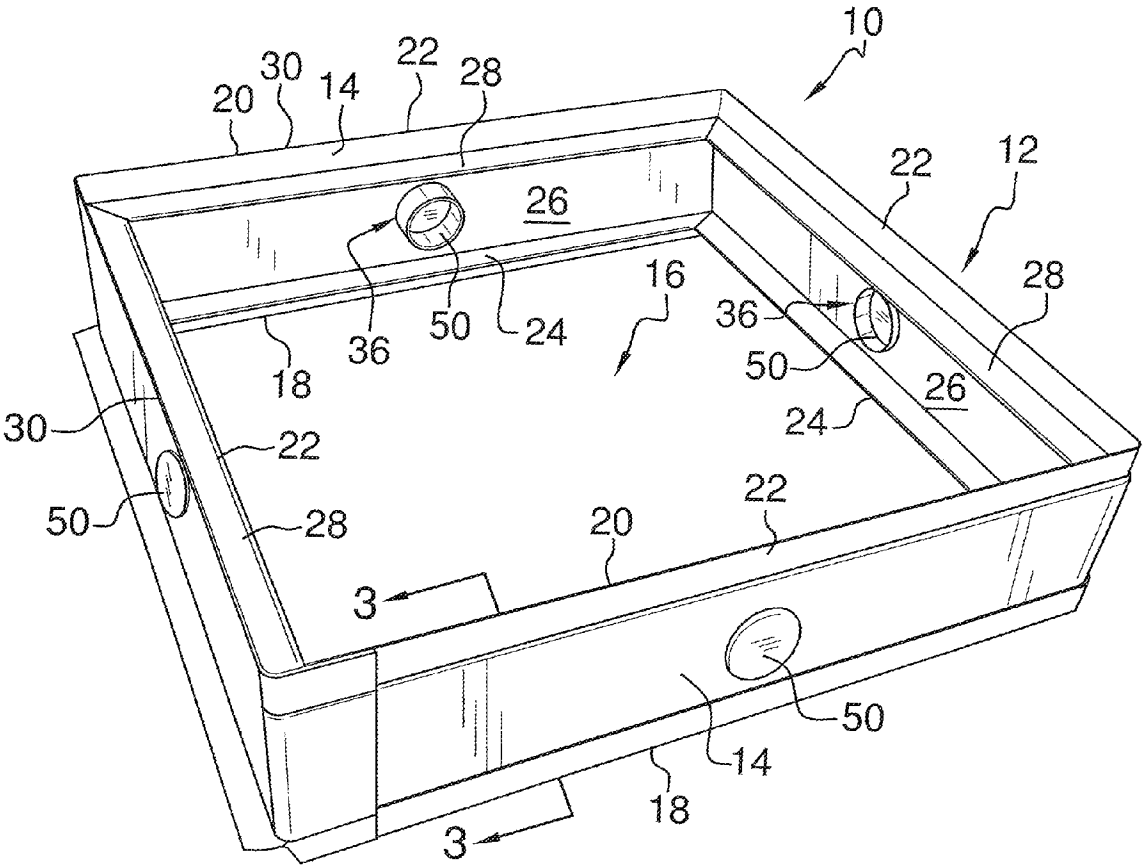
FIG. 1 is a top front side perspective view of a HVAC inspection frame device according to an embodiment of the disclosure.
Figure 2:
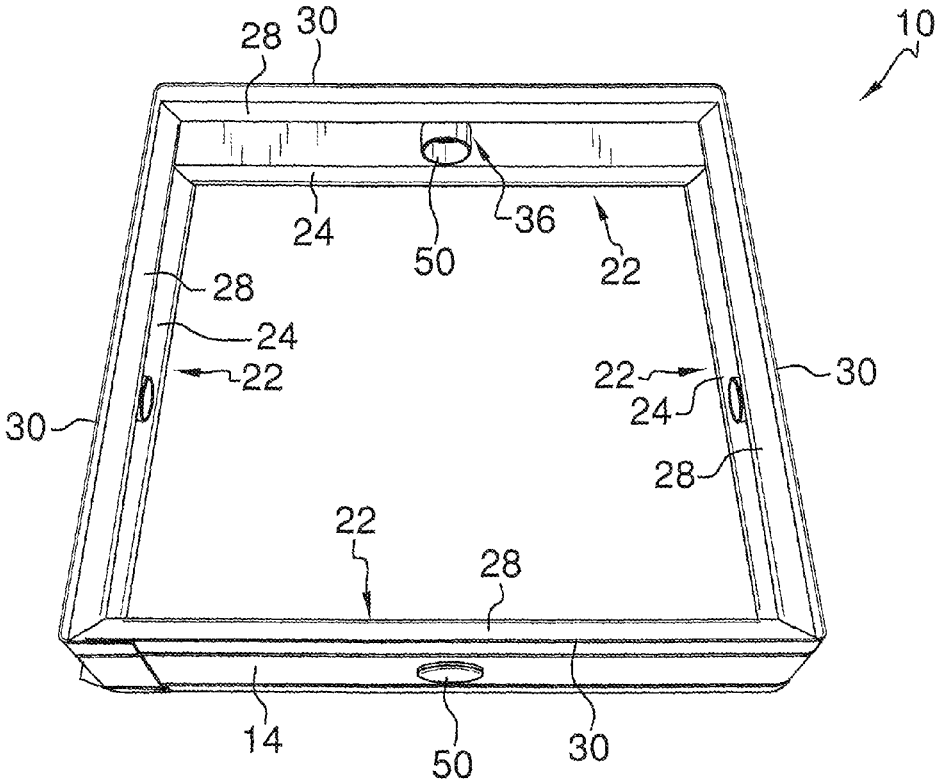
FIG. 2 is a top front perspective view of an embodiment of the disclosure.
Figure 3:
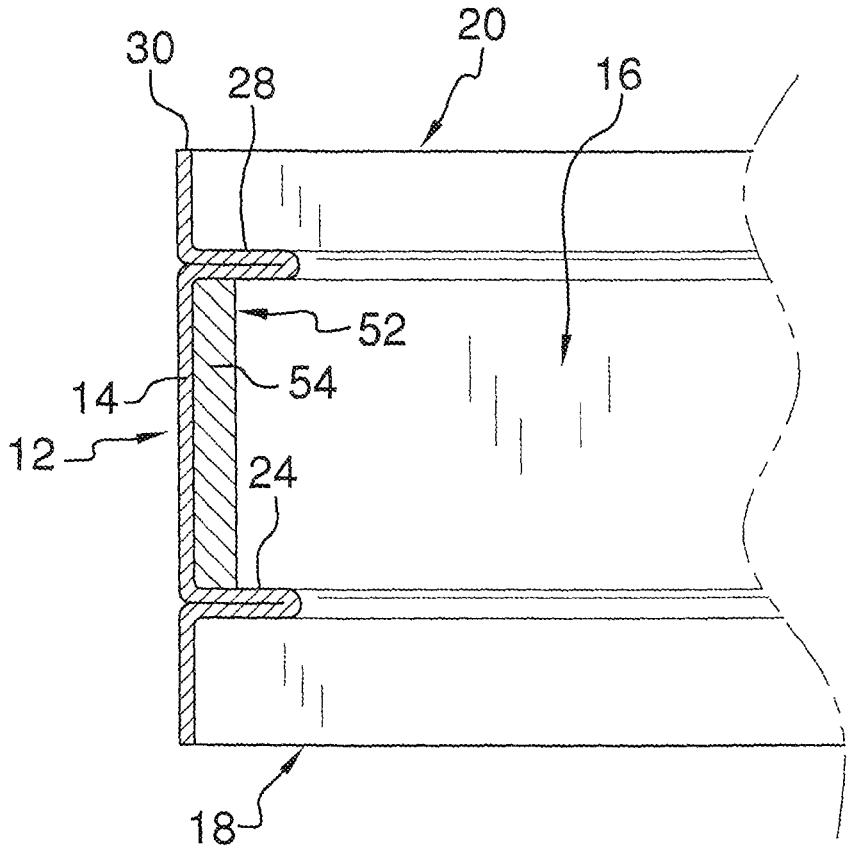
FIG. 3 is a cross-sectional view of an embodiment of the disclosure taken along line 3-3 of FIG. 1.
Figure 4:
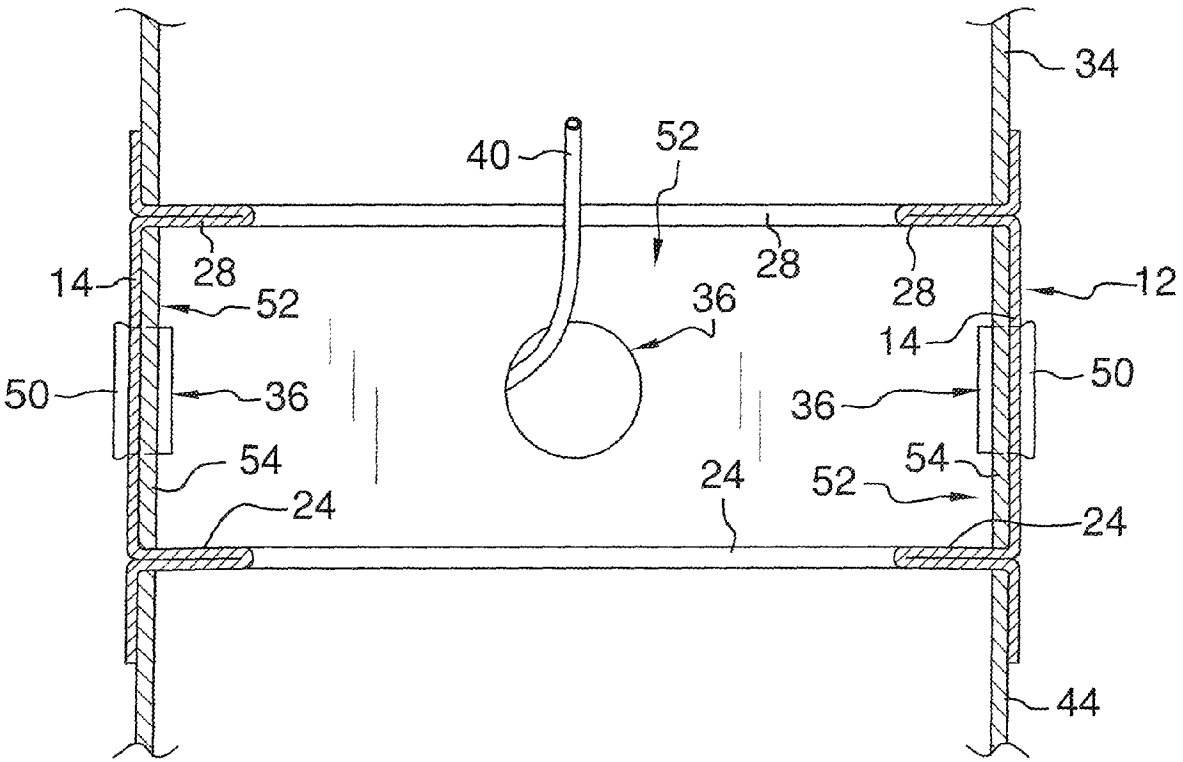
FIG. 4 is a cut-away view of an embodiment of the disclosure in use.

With reference now to the drawings, and in particular to FIGS. 1 through 4 thereof, a new HVAC equipment frame device embodying the principles and concepts of an embodiment of the disclosure and generally designated by the reference numeral 10 will be described.

As best illustrated in FIGS. 1 through 4, the HVAC inspection frame device 10 generally comprises a frame 12 having a perimeter wall 14 defining a channel 16 extending from a bottom 18 of the frame 12 to a top 20 of the frame 12. The perimeter wall 14 has four planar sides 22. A lower flange 24 is coupled to the frame 12. The lower flange 24 extends inwardly into the channel 16 from an interior face 26 of the perimeter wall 14. The lower flange 24 extends a full perimeter around the perimeter wall 14 and may be positioned in spaced parallel orientation relative to the bottom 18 of the frame 12. Thus, the lower flange 24 is configured for supporting the frame 12 on a furnace 44 or other type of HVAC machine which might require periodic repair or inspection. An upper flange 28 is also coupled to the frame 12. The upper flange 28 extends inwardly into the channel 16 from the interior face 26 of the perimeter wall 14. The upper flange 28 also extends a full perimeter around the perimeter wall 14 and may be offset from a top edge 30 of the perimeter wall 14. The upper flange 28 may also be spaced from and parallel to the top 20 of the frame 12. Thus, the upper flange 28 is configured to support an evaporator coil 34 on the upper flange 28. At least one aperture 36 is positioned in the perimeter wall 14 such that the aperture 36 is configured to receive an optical inspection device 40 such as a lens or camera through the aperture 36. The aperture 36 may be between 2 and 4 centimeters in diameter. The optical inspection device 40 provides a viewable image of the evaporator coil 34 or the furnace 44 without removing the evaporator coil 34 from the frame 12, drilling into an evaporator coil housing, or removing a panel secured to a part of the HVAC system. The aperture 36 may be one of four apertures 36. Each aperture 36 is positioned to extend through an associated one of the planar sides 22 of the perimeter wall 14. Each aperture 36 may be centrally positioned in the associated planar side 22 of the perimeter wall 14 to facilitate inspection fully around the evaporator coil 36 or furnace 44.

A plug 50 is provided for each aperture 36. Each plug 50 may be constructed from an insulative material such as rubber and may be of solid construction. Each plug 50 is insertable into the aperture 36 wherein the plug 50 engages the perimeter wall 14 and closes the aperture 36. A layer 52 of insulating material 54 is coupled to the frame 12. The layer 52 of insulating material 54 is positioned between the upper flange 28 and the lower flange 24. The layer 52 of insulating material 54 may extend fully between the upper flange 28 and the lower flange 24 and around each aperture 36. The layer 52 of insulating material 54 further extends fully around the perimeter wall 14 preventing condensation from forming on an exterior of the frame perimeter wall 14.

The exterior of the perimeter wall 14 may be provided pre-painted to match the exterior color of the furnace 44 if so desired. The lower flange 24 may extend transversely from the perimeter wall 14 a length between 1 and 2 centimeters. The upper flange 28 may extend transversely from the perimeter wall 14 a length between 1 and 5 centimeters. The upper flange 28 may have a length between 1 and 2 centimeters for a cased evaporator coil and between 3 and 5 centimeters for an uncased evaporator coil. For installation with an uncased evaporator coil, the frame 12 may be formed on site to fit the size of the furnace and uncased evaporator coil. Also, when used with the uncased evaporator coil, the perimeter wall 14 may extend upwardly a greater distance than with a cased evaporator coil to facilitate attachment of an air supply plenum.

In use, the frame 12 is installed between the furnace 44 and the evaporator coil 34. To inspect the interior of either or both of the furnace 44 and the evaporator coil 34, one or more of the plugs 50 may be removed to permit insertion and manipulation of the optical inspection device 40. The aperture 36 and plug 50 obviate disassembly or alteration of the structure of existing furnace and evaporator coil structures. The aperture 36 and plug 50 further obviate time consuming removal and replacement of access panels typically using multiple screws or fasteners. When the optical inspection is complete, the plug 50 is re-inserted into the aperture 36.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A frame device for positioning between a furnace and an evaporator coil, the device comprising:

a frame having a perimeter wall defining a channel extending from a bottom of said frame to a top of said frame;

a lower flange coupled to said frame, said lower flange extending inwardly into said channel from an interior face of said perimeter wall wherein said lower flange is configured for supporting said frame on the furnace;

an upper flange coupled to said frame, said upper flange extending inwardly into said channel from said interior face of said perimeter wall wherein said upper flange is configured to support the evaporator coil on said upper flange, said upper flange being offset from a top edge of said perimeter wall;

an aperture positioned in said perimeter wall such that said aperture is configured to receive an optical inspection device therethrough wherein the optical inspection device provides an image of the evaporator coil without removing the evaporator coil from said frame; and a plug, said plug being insertable into said aperture wherein said plug engages said perimeter wall and closes said aperture.

2. The device of claim 1, further comprising said perimeter wall having four planar sides.

3. The device of claim 2, further comprising said aperture being one of four said apertures, each said aperture being positioned to extend through an associated one of said planar sides of said perimeter wall.

4. The device of claim 3, further comprising each said aperture being centrally positioned in said associated planar side of said perimeter wall.

5. The device of claim 1, further comprising a layer of insulating material coupled to said frame, said layer of insulating material being positioned between said upper flange and said lower flange.

6. The device of claim 5, further comprising said layer of insulating material extending fully between said upper flange and said lower flange, said layer of insulating material further extending fully around said perimeter wall.

7. A frame device for positioning between a furnace and an evaporator coil, the device comprising:

a frame having a perimeter wall defining a channel extending from a bottom of said frame to a top of said frame, said perimeter wall having four planar sides;

a lower flange coupled to said frame, said lower flange extending inwardly into said channel from an interior face of said perimeter wall wherein said lower flange is configured for supporting said frame on the furnace;

an upper flange coupled to said frame, said upper flange extending inwardly into said channel from said interior face of said perimeter wall wherein said upper flange is configured to support the evaporator coil on said upper flange, said upper flange being offset from a top edge of said perimeter wall;

an aperture positioned in said perimeter wall such that said aperture is configured to receive an optical inspection device therethrough wherein the optical inspection device provides an image of the evaporator coil without removing the evaporator coil from said frame, said aperture being one of four said apertures, each said aperture being positioned to extend through an associated one of said planar sides of said perimeter wall, each said aperture being centrally positioned in said associated planar side of said perimeter wall;

a plug, said plug being insertable into said aperture wherein said plug engages said perimeter wall and closes said aperture; and a layer of insulating material coupled to said frame, said layer of insulating material being positioned between said upper flange and said lower flange, said layer of insulating material extending fully between said upper flange and said lower flange, said layer of insulating material further extending fully around said perimeter wall.

* * * * *